United States Patent [19]

Perrissoud

[11] Patent Number: 4,945,660

[45] Date of Patent: Aug. 7, 1990

[54] SKI BOOT

[75] Inventor: Claude Perrissoud, Saint-Jorioz, France

[73] Assignee: Salomon S.A., Annecy, France

[21] Appl. No.: 269,323

[22] Filed: Nov. 10, 1988

[30] Foreign Application Priority Data

Nov. 10, 1987 [FR] France ..... 87 15578

[51] Int. Cl.[5] ..... A43B 5/04

[52] U.S. Cl. ..... 36/120; 36/117

[58] Field of Search ..... 36/117–121, 36/50

[56] References Cited

U.S. PATENT DOCUMENTS

| | | | |
|---|---|---|---|
| 3,696,534 | 10/1972 | Hornung | 36/121 |
| 4,519,149 | 5/1985 | Pozzobon | 36/121 |
| 4,665,635 | 5/1987 | Benoit et al. | 36/120 |
| 4,677,770 | 7/1987 | De Marchi et al. | 36/120 |
| 4,759,137 | 7/1988 | Lederer | 36/117 |

FOREIGN PATENT DOCUMENTS

| | | | |
|---|---|---|---|
| 0285924 | 10/1988 | European Pat. Off. | 36/117 |

*Primary Examiner*—Paul T. Sewell
*Assistant Examiner*—Andrew D. Meyers
*Attorney, Agent, or Firm*—Pollock, VandeSande & Priddy

[57] ABSTRACT

An Alpine ski boot incorporating a shell base made of a rigid material, on which a shaft is jointed. The elastic means for control of the flexion of the shaft are made up of an energy cassette (8) attached onto the rear cover (5) which contains an elastic deformable element (9) and at least one connecting device (12, 13) extending between that element (9) and an anchoring point (14) on the shell base (1) beneath the energy cassette (8). The connecting device (12, 13) is put into traction whenever the shaft (2) pivots forward, and remains inoperative during rearward pivoting motion of the rear cover alone (5).

19 Claims, 4 Drawing Sheets

SKI BOOT

FIELD OF THE INVENTION

The present invention concerns an Alpine ski boot having a shaft jointed onto a shell base, said shaft being itself composed of two parts capable of being tightened around the skier's lower leg by means of tightening devices; these two pieces are a sleeve jointed on the shell base around a lower transverse pin, and a rear cover, the lower portion of which is jointed to lower and rear components which are extensions of the sleeve, around another horizontal, transverse pin independent of the first.

BACKGROUND OF THE INVENTION

A well-known ski boot, of the type involving entry of the foot from the rear, such as that described, for example, in U.S. Pat. No. 4,677,770, incorporates elastic means for controlling the flexion of the shaft; these means are found in the area of the pin which joints the rear cover to the rear extension components of the sleeve. In order to allow a ski boot of this type to be put on and removed by means of a rearward pivoting of the rear cover around the jointing pin which connects the cover to the rear extension components of the sleeve, the elastic means for controlling flexion are arranged in such a way as to cause interaction between said jointing pin and the shell base. This arrangement gives freedom of rotation to the jointing pin; however, because of the relative proximity of this pin to the shell base, and especially to its stopping system, the design and lay-out of the elastic means of flexion control must be delicately determined in the space left free in the posterior region of the boot. Furthermore, because of the action exerted directly by the elastic means on the jointing pin, the pivoting of this pin is somewhat hindered, at least for the value ascribed to friction.

SUMMARY OF THE INVENTION

The purpose of the present invention is to remedy this drawback by creating an Alpine ski boot of the rear foot-entry type which incorporates two jointing pins axes, and in which the movement, beginning from the static position in which the boot is put on and removed, involving the opening out of the rear cover occurs without meeting any resistance from the shaft flexion control system.

For this purpose, this Alpine ski boot incorporates a shell base, made of a rigid material, to which is connected, around a lower horizontal, transverse axis, a shaft which is itself composed of two parts which may be tightened around the skier's lower leg using tightening devices, namely, of a rear sleeve connected by a joint to the shell base around the above-mentioned axis, and of a rear cover connected to rear extensions of the anterior sleeve around a second horizontal, transverse axis. This boot, which incorporates elastic means for controlling the flexion of the shaft which apply resistance to the forward pivoting motion of the shaft when forward flexion occurs during skiing, is characterized by the fact that the elastic means for controlling flexion of the shaft incorporate an energy cassette attached to the rear cover and containing a deformable elastic element, and at least one connecting element extending between the deformable elastic element and an anchoring point on the shell base underneath the energy cassette. Traction, at the least, is exerted on this connecting element whenever the tightened shaft pivots forward, causing a deformation in the elastic element. On the other hand, the connecting element remains non-operational in the static position in which the boot is put on or removed, when the posterior cover alone pivots rearward around the second pin, and does not, therefore, exert any resistance to this pivoting movement.

When the shaft of the boot is in the initial, or resting, position, the connecting element is in the neutral position, and may or may not be able to produce an initial spring-like motion before acting on the energy cassette.

If, in the neutral position, it has no play or is slightly loosened, as soon as the shaft begins to pivot forward, this position allows it to be subjected to the force of traction. If, on the other hand, it is in the neutral position but may produce a spring-like motion, the onset of traction occurs only after a specific angular fluttering of the shaft, which in this case occurs without meeting any resistance exerted by the deformable elastic element. This connecting device may be slightly prestressed as it undergoes initial traction, in such a manner that the initial stress of traction increases as the shaft pivots forward. The initial prestressing of the connecting device in the resting state facilitates, upon loosening of the shaft, the opening up of the rear cover, which is then drawn rearward by the connecting element, which is slightly prestressed as it undergoes traction.

"Flexible connecting element" in the description signifies any device producing a unidirectional force which establishes a substantially rigid connection between the deformable elastic element in the energy cassette and the anchoring point whenever the shaft pivots forward, and which, to the contrary, is "relaxed" or "slackens" whenever the posterior cover swings backward in the static position of the shaft allowing the boot to be put on or taken off.

BRIEF DESCRIPTION OF THE DRAWINGS

In order that the invention may be more clearly understood, it will now be described with reference to the accompanying drawings, wherein several embodiments of the invention are shown for purposes of illustration and wherein.

DESCRIPTION OF THE PREFERRED EMBODIMENTS

Figure 1:
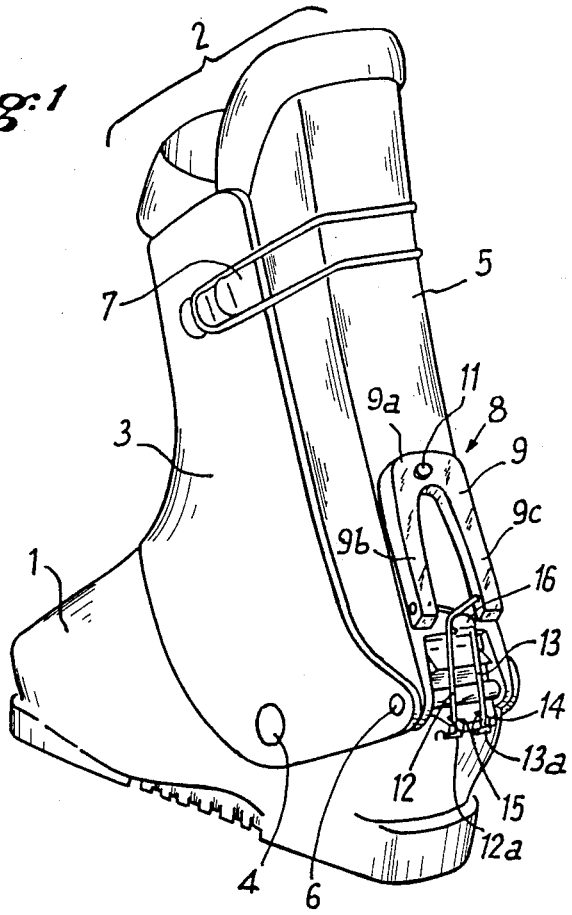
FIG. 1 is a perspectival view of an Alpine ski boot having a jointed shaft according to the invention.

The Alpine ski boot having a jointed shaft as shown in FIG. 1 incorporates a shell base 1, on which a shaft 2 is jointed. This shaft is made up of two parts: a forward sleeve 3 whose lower portion is jointed to the shell base 1 around a horizontal, transverse axis 4, and a posterior cover 5, whose lower portion is jointed to the lower, posterior extensions 3*a* of the sleeve 3, around a horizontal, transverse axis 6. During skiing, the anterior sleeve 3 and the posterior cover 5 are held in a tightened position around the skier's lower leg, by means of any well-known type of tightening device 7.

The boot shown in FIG. 1 incorporates, in its lower, posterior portion, a means for exerting resistance to the forward flexion of the shaft 2 during skiing. These means comprise an energy cassette 8 attached to the lower portion of the posterior surface of the cover 5. This energy cassette 8 is essentially comprised of an elastic piece 9 in the shape of a U or of a fork with two arms, which opens toward the bottom and whose upper, horizontal central part 9*a* is attached to the cover 5 by at least one fastening device 11 such as a rivet, a bolt, a screw, etc. The flexible fork 9, further comprises two flexible arms 9*b*, 9*c* which extend freely downward from the upper central portion 9*a*, and either contact or are at a slight distance from the outer surface of the cover 5. To lower ends of the flexible arms 9*b*, 9*c* are hooked, respectively, the ends of two flexible linking elements 12, 13, such as cables, which extend downward, with or without slack, and whose respective lower ends 12*a*, 13*a* are held by an anchoring block 14 forming one piece with the posterior portion of the shell base 1 beneath the energy cassette. This anchoring block 14 may advantageously be molded with the shell base 1. In the embodiment shown in FIG. 1, the anchoring block 14 is constituted by a rearward projection, in whose posterior edge two notches 15 are cut. The two flexible linking elements 12, 13 respectively pass through these notches, and the stop-heads constituting the ends 12*a*, 13*a* of the flexible linking elements 12, 13 are housed below these notches.

A reversing stop 16, attached to the shell base 1 and molded most advantageously of one piece with the shell base 1 or with the anchoring block 14, is provided below the anchoring block 14 and substantially at the level of the lower ends of the flexible arms 9*b*, 9*c*. This reversing stop 16 forms a projection having a rounded upper surface located substantially between the two ends of the two flexible arms 9*b*, 9*c*. The flexible linking elements 12, 13 cross while passing over the rounded upper surface of the reversing stop, and remain parallel to each other while extending downward. In other words, the left flexible connector 12 extends vertically, with or without slack, from its lower end 12*a*, where it is held by the anchoring block 14, to the reversing stop 16, which deflects it toward the right as it extends above the reversing stop, thus enabling it to be attached to the end of the right flexible arm 9*c*. Similarly, the right flexible connector 13 extends vertically, with or without slack, from the anchoring block 14, where it is held by its stop-head 13*a*; it then passes over the reversing stop where it is deflected toward the left, before being hooked to the lower end of the left flexible arm 9*b*.

When the shaft 2 is in the initial, or resting, position, the flexible connectors 12, 13 which preferably extend without slack between the anchoring block 14 and the flexible arms 9*b*, 9*c*, may or may not be subjected to slight prestressing from traction. When the shaft 2 pivots forward about axis 4 during a forward bending motion during skiing, the fork 9 with its two flexible arms 9*b*. 9*c* follows this motion. Consequently, as soon as the shaft 2 begins to bend forward, traction is exerted on the two flexible connectors 12, 13, because the lower ends of the flexible arms 9*b*, 9*c* separate from the anchoring block 14, and because said two flexible connectors extend without slack between the flexible arms 9*b*, 9*c* and the anchoring block 14. This traction causes the lower ends of the flexible arms 9*b*, 9*c* to move closer together, and the flexion-induced deformation of shape generates resistance to the forward flexion.

When the skier wants to remove a boot, the posterior cover 5 opens up very easily after loosening the elements 7, since there is no force resisting this opening. In fact, to ensure that the shaft 2 opens when the posterior cover 5 pivots backward around the axis 6, the lower ends of the two flexible arms 9*b*, 9*c* move closer to the anchoring block 14 and the flexible connectors 12, 13 then acquire slack, without providing any resistance to this movement. If the flexible connectors 12, 13 are subject to slight, intial prestressing from traction, this prestressing causes a slight automatic opening motion in the posterior cover 5 as soon as the shaft 2 is loosened.

Figure 2:
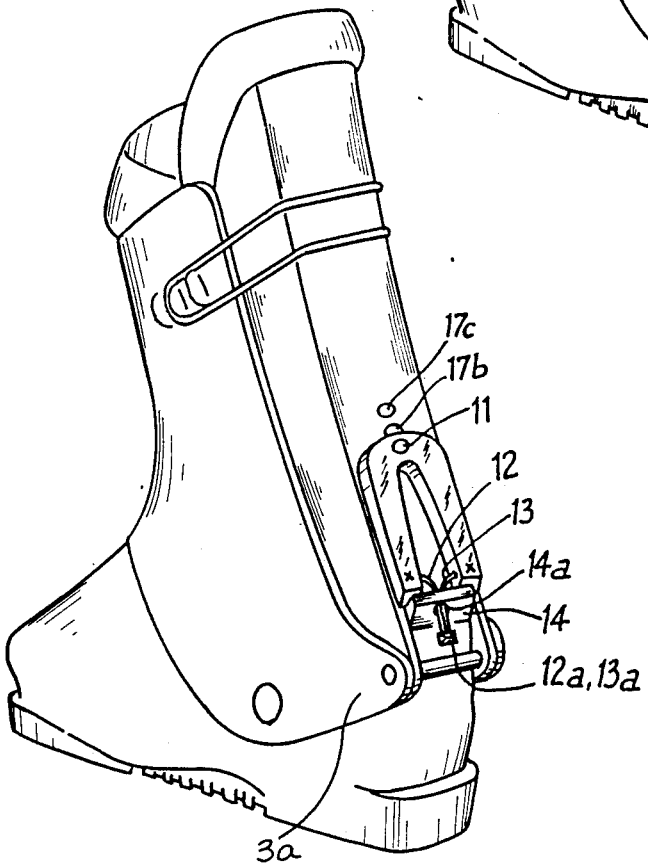
FIG. 2 is a perspectival view of another embodiment of the Alpine ski boot having a jointed shaft according to the invention.
Figure 3:
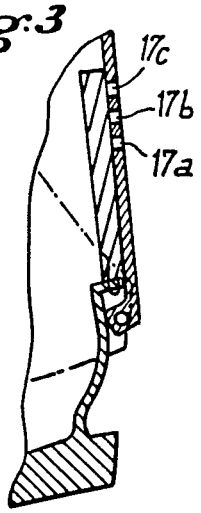
FIG. 3 is a partial vertical and longitudinal cross-section of the boot shown in FIG. 2.

In the embodiment of the invention shown in FIGS. 2 and 3, the anchoring block 14 which receives the two flexible connectors 12, 13 also constitutes a lower stop, which provides support to the lower ends of the two flexible arms 9*b*, 9*c*. This anchoring block 14 thus delimits the rear point of support for the shaft 2 of the boot. In this case, the energy cassette 8 is most advantageously mounted in an adjustable, vertical position on the rear surface of the posterior cover 5, in order to be able to vary, in correlation, the inclination or the projecting position of the shaft 2 in the resting or initial position. For this purpose, the element 11 which ensures the attachment of the energy cassette 8 to the cover 5 may be inserted into one of several holes 17*a*, 17*b*, 17*c* drilled into the posterior surface of the cover 5, one above the others. In the position illustrated in FIG. 2, the fastening element 11 is inserted in the lowest hole, in such a way that, as a result of the support of the lower ends of the two flexible arms 9*b*, 9*c* provided by the anchoring block 14, the shaft 2 is at its maximum possible forward inclination in the resting position. If the fastening element 11 is inserted into one of the upper holes, 17*b*, 17*c*, the shaft 2, in resting position, is correlatively less forwardly inclined.

FIG. 2 also shows that the two flexible connectors 12 and 13 pass through a central hole 14*a* of the anchoring block 14, and their lower ends 12*a*, 13*a* are attached by suitable means below the hole 14*a*. The flexible connectors 12, 13 thus extend side by side beginning at their lower ends 12*a*, 13*a*, which are secured by the anchoring block 14, then pass together through the central hole 14*a* of the anchoring block and, above this hole, diverge to the right and left, before being hooked to to the lower ends of the left 9*b* and right 9*c* flexible arms.

Figure 4:
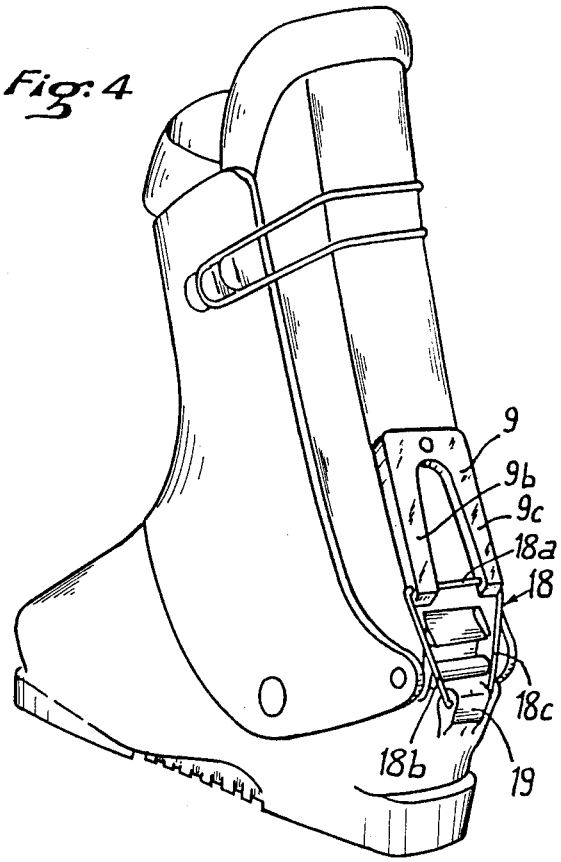
FIGS. 4 and 5 are perspective views of other embodiments of the boot.

In the embodiment shown in FIG. 4, the lower end portions of the two flexible arms 9*b*, 9*c* of the fork 9 are connected by a single flexible connecting element 18, without slack, which runs through the horizontal coaxial holes drilled in these end pieces. The single flexible connecting piece 18 thus forms an upper, horizontal strand 18*a*, which passes through the holes drilled in the two arms 9*b*, 9*c*, and which is extended by two downwardly-extending strands 18*b*, 18*c* whose ends are attached to an anchoring block 19 forming one piece with the shell base 1. Here again, when the shaft 2 pivots forward as a result of a forward, flexion-induced motion, the flexible connecting element 18 is stressed by traction, and, because its ends are attached to the anchoring block 19, this connector causes the two flexible arms 9*b*, 9*c* to move toward each other, and the connector 18 slides into the holes drilled in these arms.

Figure 5:
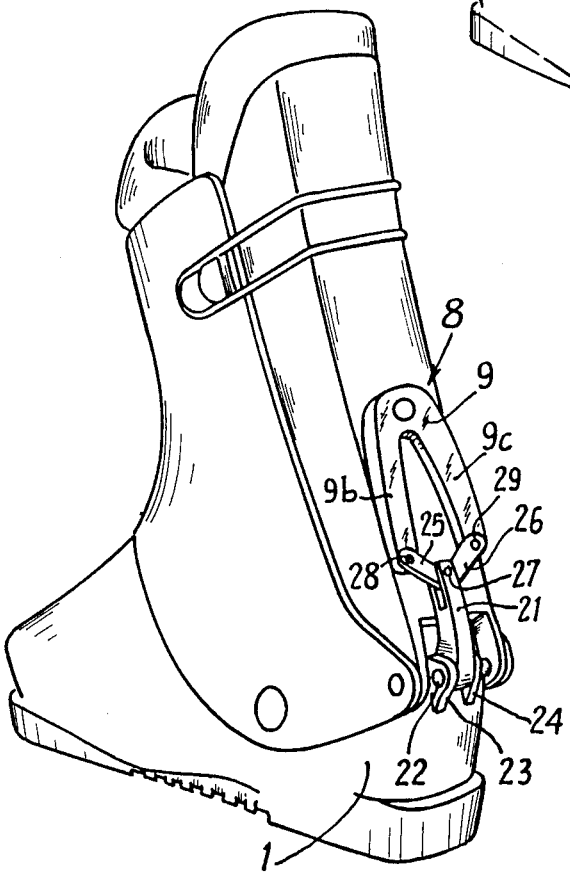
Figure 6:
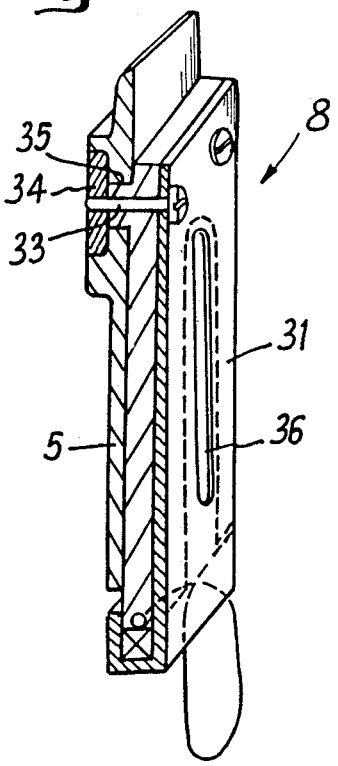
FIG. 6 is a perspective view, partially in vertical cross-section and on a larger scale, of an energy cassette of the type used on the boot shown in FIG. 1.
Figure 7:
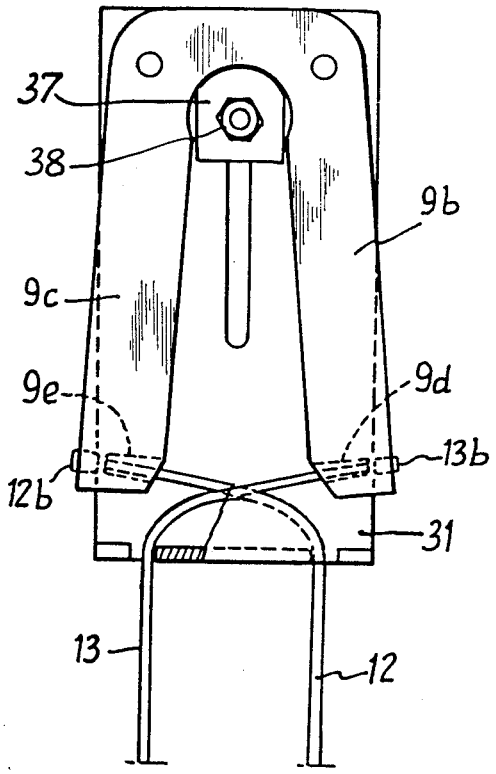
FIG. 7 is an elevation view, taken from the front, of the energy cassette shown in FIG. 6.
Figure 8:
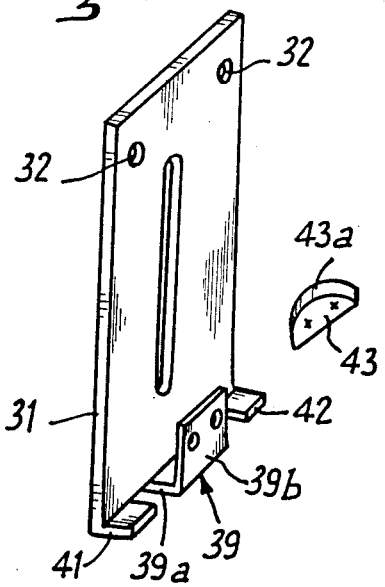
FIG. 8 is a perspective view of the metal sheet acting as base of support for the energy cassette shown in FIG. 6.
Figure 9:
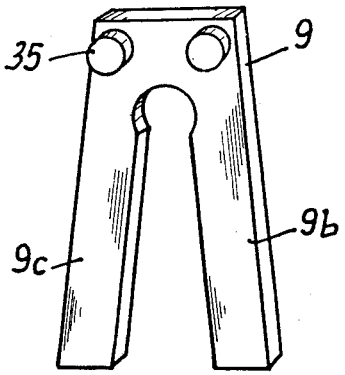
FIG. 9 is a perspective view of the flexible fork used in the energy cassette shown in FIG. 6.

In the embodiment shown in FIG. 5, the connection between the flexible fork 9 of the energy cassette 8 and the shell base 1 is ensured by a mechanism composed of a substantially vertical fork 21 whose lower end is jointed to the shell base 1, around a horizontal, transverse axis 22, which is substantially coaxial with the axis 6 which joins the posterior cover 5 to the sleeve. This axis 22 is carried by two parallel vertical wings 23, 24, which are molded with the shell base 1 and provided with axial holes aligned horizontally and transversly. The fork 21 has, at its upper end, two connecting rods 25, 26 which are jointed together to the upper part of the fork 21 around a common axis 27, and which are jointed respectively to the lower ends of the two flexible arms 9*b*, 9*c*, respectively, around the axes 28, 29. Consequently, when the shaft 2 is flexed forward, the jointing axes 28, 29 shift upward, thus causing the two connecting rods 25, 26 to pivot toward each other, around their common jointing axis 27, which is held immobile because the lower end of the fork 21 is attached to the shell base I. As a result, the two jointing axes 28, 29 move toward each other, causing an elastic deformation of the two flexible arms 9*b*, 9*c* in which they are inserted. This elastic deformation creates, in turn, the desired resistance to the forward flexion of the shaft. On the other hand, when the skier wants to remove a boot, the mechanism described above exerts no resistance in the static position of the shaft in which the boot may be put on or taken off. In fact, in this position, after releasing the tightening devices 7, the skier can make the posterior cover 5 pivot freely toward the rear, without requiring the action of the mechanism connecting with the energy cassette 8. This is due to the fact that the pin 22 joining the fork 21 to the shell base 1 is coaxial with the axis of the cover 5 on the sleeve 3.

FIGS. 6 through 9 illustrate an embodiment of the energy cassette. This cassette incorporates a rectangular sheet-metal plate 31, which makes up the external, posterior surface of the energy cassette 8 and which is attached to the cover 5. The upper portion of this sheet-metal plate 31 has holes 32 drilled in it, through which screws 33 are placed to attach it to the cover 5. These screws are screwed into a sheet-metal nut 34 which is placed on the inside of the cover in a housing formed for this purpose within the inner surface. Furthermore, the fork 9 is housed underneath the sheet-metal plate 31, between it and the external surface of the cover 5; holes are drilled into its upper part, through which the attaching screws 33 are driven. Where these holes are drilled, the fork 9 has bosses 35 which project outward in relation to the surface of the fork 9 touching the cover 5; these bosses 35 fit in the holes of the same diameter in the wall of the cover 5. The sheet-metal plate 31 also has a vertical, longitudinal slot 36 which makes it possible to immobilize a slider 37 in an adjustable longitudinal position, thus adjusting the stiffness of the spring made up of the flexible arms 9*b*, 9*c*. This slider is mounted so as to allow it to slide underneath the sheet-metal plate 31 and between the two flexible arms 9*b*, 9*c*, and it is kept immobile in the appropriate position by the locking action provided by a screw 38 which passes through the slider 37 and the longitudinal slot 36.

At its lower end, the sheet-metal plate 31 has an angle iron 39 emanating from the central portion of its lower edge, and comprising a horizontal wing 39*a* extending toward the cover 5 and a vertical wing 39*b* extending upward. This angle iron 39 is installed between two lateral flared pieces 41, 42 folded back toward the angle iron and emanating from the lower edge of the sheet-metal plate 31. The central angle iron 39 thus forms, in conjunction with the two lateral flared pieces 41, 42, two openings through which pass, respectively, the two flexible connectors 12, 13. In addition, the central angle iron 39 holds in place an added piece 43, the equivalent of the reversing stop 16 in FIG. 1, which is secured in the angle iron 39 by screws that fit through holes drilled into the vertical wing 39*b* of the angle iron and are then secured in the piece 43. This piece 43 has the shape of a section of a cylinder, and has an arched upper surface 43*a*. The two flexible connectors 12, 13 pass across this surface 43*a* as they extend toward the lower ends of the two flexible arms 9*b*, 9*c*. As can be best seen in FIG. 7, the upper ends of the two flexible connectors 12, 13 pass through the two transverse holes 9*d*, 9*e* drilled straight through the lower ends of the two flexible arms 9*b*, 9*c*; these ends are then attached to ellipsoidal plugs 12*b*, 13*b* wedged into said holes.

Figure 10:
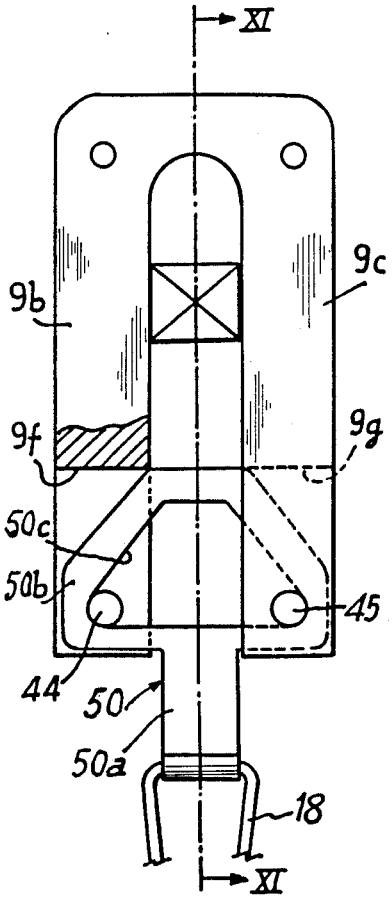
FIG. 10 is an elevation view in partial cross-section of another embodiment of the energy cassette incorporated into the boot.
Figure 11:
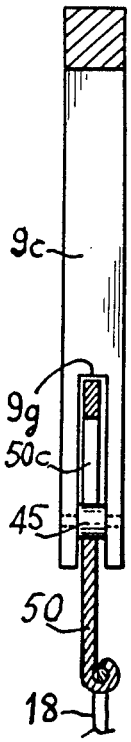
FIG. 11 is a cross-sectional view along the line XI—XI in FIG. 10.

In the embodiment of the invention shown in FIGS. 10 and 11, the single flexible connector 18 is attached to a sheet-metal pin 50 having a longitudinal lower tongue 50*a*, to which the flexible connector 18 is fastened, and an upper head 50*b* in the shape of an isoceles trapezoid. This head 50*b* fits into coplanar slots 9*f*, 9*g* cut into the lower parts of the two flexible arms. Two rollers 44, 45, making up one piece with the two flexible arms 9*b*, 9*c*, extend respectively across the two slots 9*f*, 9*g*. These rollers 44, 45 also pass through an opening 50*c* in the head 50*b*, said opening being in the shape of an isoceles trapezoid. The two rollers 44, 45 are installed at the two vertices of the long side of the isoceles trapezoid making up the opening 50*c*, whose small base is directed upward. In this arrangement, when traction is exerted on the connector 18, as a result of the upward movement of the fork 9 when the shaft 2 is bent forward, the rollers 44, 45 slide along the sloping sides converging toward the top of the trapezoidal opening 50*c*. These sides, which form immobile ramps, cause the rollers 44, 45 to move toward each other, thus causing the two flexible, elastic arms 9*b*, 9*c* to also come closer together.

Figure 12:
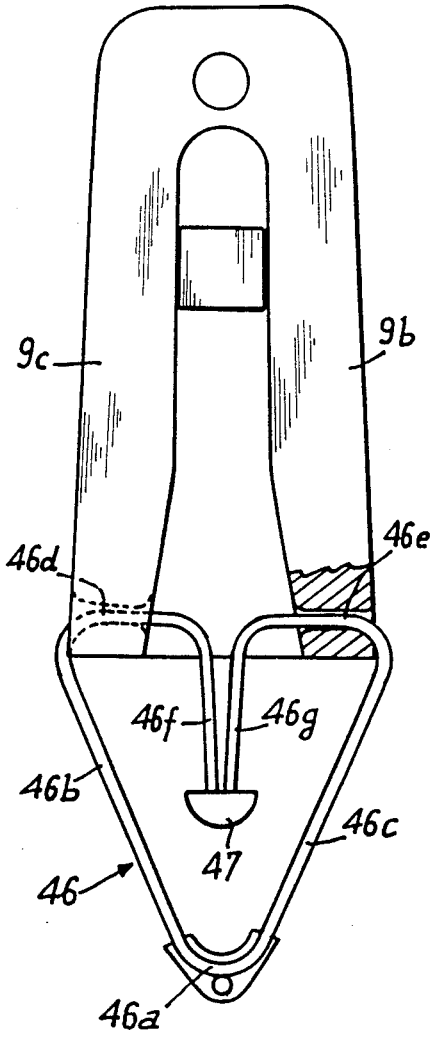
FIG. 12 is an elevation view, partly in cross-section, of another embodiment of the energy cassette mounted on the boot.

In the embodiment shown in FIG. 12, the lower ends of the two flexible arms 9*b*, 9*c* of the fork 9 are connected by a single flexible connector 46 forming a V with the tip pointing downward; the lower vertex 46*a* is supported by an anchoring pin of one piece with the shell base. This flexible connector 46 forms, beginning at the lower tip 46*a*, two lateral strands 46*b*, 46*c* sloping upward and from the interior toward the exterior; these strands are extended respectively by horizontal strands 46*d*, 46*e* extending toward each other and passing through the holes 9*e*, 9*d* of the two flexible arms 9*c*, 9*d*. The end strands 46*f*, 46*g*, which continue the respective horizontal strands 46*d*, 46*e*, run downward after passing through the holes 9*e*, 9*d* and are attached to the shell base at a central anchoring point 47.

What is claimed is:

1. Alpine ski boot comprising a shell base made of a rigid material, on which shell base is jointed, around a lower horizontal, transverse axis, a shaft composed of two pieces adapted to be tightened by tightening devices around a lower leg of a skier, said two pieces including a sleeve on a front part of the boot jointed onto the shell base around said axis and a rear cover jointed onto rear extensions of said sleeve around a second horizontal, transverse axis, said boot comprising elastic means for controlling flexion of said shaft which exert resistance to pivoting motion of the shaft, at least toward the front, in the case of forward flexion during skiing, wherein said elastic means comprise an energy cassette (8) attached to said rear cover (5) including an elastic deformable element (9) and at least one connector (12, 13; 18; 21–29; 46) extending between said elastic deformable element (9) and an anchoring block (14, 19) located on said shell base (1) beneath said energy cassette (8), said connector (12, 13; 18; 21–29; 46) being in traction whenever said shaft (2) pivots forward, thereby causing said connector to deform said elastic deformable element (9), said connector being inoperative in a static position of said shaft in which said boot is put on and removed, during rearward pivoting of said rear cover (5) alone about said second axis (6) and when said connector produces no resistance to pivoting movement of said shaft.

2. Alpine ski boot according to claim 1, wherein the connector (12, 13; 18; 46) is a flexible tie.

3. Alpine ski boot according to claim 1 or 2, wherein the connector (12, 13; 18; 21–29; 46) runs with at most a slight looseness when the shaft (2) of the boot is in a rest position allowing the boot to be selectively put on and removed.

4. Alpine ski boot according to claim 2, wherein said connector (12, 13; 18; 46) is slightly prestressed by traction whenever the shaft (2) of the boot is in a rest position.

5. Alpine ski boot according to claim 1 or 2, wherein the elastic deformable element (9) in the energy cassette (8) has a U-shape, opening downward, and the upper part (9*a*) of the device (9) is attached to the rear cover (5), said deformable element (9) having two flexible arms (9*b*, 9*c*) extending freely downward from an upper portion (9*a*) while distance is maintained between them with attachment of said connector (12, 13; 18; 21–29; 46) to lower end portions of the two flexible arms (9*b*, 9*c*).

6. Alpine ski boot according to claim 5, wherein the anchoring block (14) constitutes a lower stop which provides support to the lower ends of the two flexible arms (9*b*, 9*c*) which abut against it.

7. Alpine ski boot according to claim 6, wherein the energy cassette (8) is mounted in an adjustable vertical position on the rear cover (5).

8. Alpine ski boot according to claim 7, wherein the cover (5) has several holes (17*a*, 17*b*, 17*c*) drilled in its rear surface in a vertical row, and the energy cassette (8) is attached to the cover (5) by means of at least one element (11) which engages in one of said holes (17*a*, 17*b*, 17*c*).

9. Alpine ski boot according to any one of claims 6, 7 or 8, wherein the connector is made up of two flexible connector elements (12, 13), such as cables, which are fastened to the lower ends of the flexible arms (9*b*, 9*c*) and to the anchoring block (14) which is of one piece with the shell base (1).

10. Alpine ski boot according to claim 9, wherein the two flexible connector elements (12, 13) cross over each other and pass over an upper rounded surface of a reversing stop (16), before extending parallel to each other and downward to points of attachment on the anchoring block (14).

11. Alpine ski boot according to claim 10, wherein the anchoring block (14) is formed by a rearward projection provided with two notches (15) in its rear edge, through which pass respectively the two flexible connector elements (12, 13), and beneath which are housed stops forming the ends (12*a*, 13*a*) of the flexible connector elements (12, 13).

12. Alpine ski boot according to claim 10 or 11, wherein the energy cassette (8) comprises a rectangular sheet-metal plate (31) constituting a rear, external surface of the energy cassette (8) and being attached to said cover (5), said plate (31) having, in its upper part, through holes (32) through which screws (33) are driven for attaching said plate to said cover (5) a fork (9) being housed between beneath said plate (31) between said plate and an external face of said cover (5) and having holes in its upper portion for receiving fastening screws (33), said plate (31) containing a vertical, longitudinal slot (36) which makes it possible to hold a slider (37) immobile in an adjustable, longitudinal position, said slider (37) causing variation in the rigidity of the spring formed by the flexible arms (9*b*, 9*c*), and being mounted for sliding movement beneath said plate (31) and between the two flexible arms (9*b*, 9*c*) and being held immobile in an appropriate position by blockage action produced by a screw (38) passing through the slider (37) and the longitudinal slot (36).

13. Alpine ski boot according to claim 12, wherein, at the spot where the fastening screws (33) pass through the holes, the fork (9) has bosses (35) which project outward in relation to a surface of said fork (9) which contacts said cover (5), said bosses engaging in holes of the same diameter drilled in the wall of the cover (5).

14. Alpine ski boot according to claim 13, wherein, at its lower end, the sheet-metal plate (31) has an angle iron (39) extending from a central portion of its lower edge, said angle iron comprising a horizontal wing (39*a*) pointed toward the cover (5) and a vertical wing (39*b*) extending upward, said angle iron (39) being located between two lateral pieces (41, 42) folded back toward the angle iron and extending from the lower edge of said plate (31), such that said angle iron (39) delimits, in conjunction with the two lateral pieces (41, 42), two openings through which pass, respectively, the two flexible connector elements (12, 13), said angle iron (39) also holding in place a reversing stop (43) having the shape of a section of a cylinder and having an upper arched surface (43*a*) over which pass the two flexible connector elements (12, 13) extending toward the lower ends of the two flexible arms (9*b*, 9*c*), upper ends of the two flexible connector elements (12, 13) passing through transverse holes (9*d*, 9*e*) through lower end parts of the two flexible arms (9*b*, 9*c*) and being attached to ellipsoidal plugs (12*b*, 13*b*) wedged into said holes.

15. Alpine ski boot according to claim 14, wherein, said reversing stop piece (43) for the flexible connector elements (12, 13) is fastened within the angle iron (39) by screws driven through holes drilled in the vertical wing (39*b*) of the angle iron (39) and screwed into said reversing stop piece (43).

16. Alpine ski boot according to claim 9, wherein the two flexible connector elements (12, 13) pass through a central hole (14*a*) in the anchoring block (14), and their lower ends (12*a*, 13*a*) are attached beneath the hole (14*a*) in such a way that the flexible connector elements (12, 13) extend side by side beginning from their lower ends (12*a*, 13*a*), and, retained by the anchoring block (14), pass together through the central hole (14*a*) and, above this hole, before being attached to the lower ends of the flexible arms (9*b*, 9*c*).

17. Alpine ski boot according to any one of claims 6, 7 or 8, wherein lower end pieces of the two flexible arms (9*b*, 9*c*) are connected by a single flexible connector element (18) which passes through the holes in said lower end pieces, such that the single flexible connector element (18) forms an upper horizontal strand (18*a*) passing through the two arms (9*b*, 9*c*) and extended by two downwardly extending strands (18*b*, 18*c*) having ends which are fastened to an anchoring block (19) which is of one piece with the shell base (1).

18. Alpine ski boot according to any one of claims 6, 7 or 8, wherein lower end pieces of the two flexible arms (9*b*, 9*c*) are connected by a single flexible connector element extending in a "V" shape with the tip pointed downward, a lower tip (46) of said connector element being supported on an anchoring pin forming one piece with the shell base (1), such that the flexible connector (46) forms, beginning at its lower tip (46*a*), two lateral strands (46*b*, 46*c*) sloping upward and from the inside outward, said lateral strands (46*b*, 46*c*) being extended respectively by horizontal strands (46*d*, 46*e*) extending toward one another and passing through the holes (9*e*, 9*d*) in the two flexible arms (9*c*, 9*d*), such that end strands (46*f*, 46*g*) extending the respective horizontal strands (46*d*, 46*e*) extend downward after passing through the holes (9*e*, 9*d*) and are fastened to the shell base at a central anchoring point (47).

19. Alpine ski boot according to any one of claims 6, 7 or 8, wherein the connector is a mechanism containing an approximately vertical fork (21) whose lower end is jointed onto the shell base (1) around a horizontal, transverse axis (22), which is approximately coaxial with the axis (6) joining said cover (5) to said sleeve (3), and wherein the fork (21) has, at its upper end, two connecting rods (25, 26) which are jointed together onto the upper end of said fork (21) around a common axis (27), and which are jointed respectively onto the lower ends of the two flexible arms (9*b*, 9*c*), respectively, about said axes (28, 29).

* * * * *